United States Patent [19]

Franzén et al.

[11] 4,067,398

[45] Jan. 10, 1978

[54] RING DRILLING RIG

[75] Inventors: Sven Mauritz Franzén, Jarfalla; Lars Magnus Gunnar Söderlund, Skarholmen, both of Sweden

[73] Assignee: Atlas Copco Aktiebolag, Nacka, Sweden

[21] Appl. No.: 689,802

[22] Filed: May 25, 1976

[30] Foreign Application Priority Data

June 4, 1975 Sweden ..... 7506370

[51] Int. Cl.[2] ..... E21C 5/00

[52] U.S. Cl. ..... 173/43; 173/23

[58] Field of Search ..... 173/39, 40, 41, 42, 173/43, 44, 23, 25

[56] References Cited

U.S. PATENT DOCUMENTS

| | | | |
|---|---|---|---|
| 1,978,368 | 10/1934 | Levin | 173/40 |
| 3,333,646 | 8/1967 | Hoen et al. | 173/43 |
| 3,431,983 | 3/1969 | Jacobson | 173/43 |
| 3,481,409 | 12/1969 | Westerlund | 173/43 |
| 3,809,344 | 5/1974 | Kolderup et al. | 173/28 |
| 3,896,885 | 7/1975 | Dahlstrom et al. | 173/43 |

*Primary Examiner*—Robert A. Hafer

*Attorney, Agent, or Firm*—Flynn & Frishauf

[57] ABSTRACT

A ring drilling rig for rock drilling has a feed beam for a rock drill. The feed beam is mounted in a holder on the distal end of an arm that is mounted on a support. The support is tiltable about a transverse horizontal axis. The arm is swingable 360° about a longitudinal axis to which it is perpendicular. The feed beam and its holder are pivotable about an axis that is parallel with the axis about which the arm swings. The feed beam is axially displaceable in its holder.

17 Claims, 7 Drawing Figures

RING DRILLING RIG

BACKGROUND OF THE INVENTION AND OBJECT OF THE INVENTION

This invention relates to a ring drilling rig for rock drilling. Such rigs are used for production drilling for example in sub level stoping. Very often, a drift is located in the wall of a steeply dipping ore body so that only a part of a full ring is to be drilled. Preferably holes should be drilled along the wall not withstanding that the location of the wall in the drift and the steeping can vary. It is also desirable that the ring drilling rig can be used for opening up the initial raise and the initial slot in sub level stoping a by series of parrallel holes. For these and other reasons it is an object of the invention to provide a versatile ring drilling rig that is capable of drilling transverse holes in various drilling patterns.

DETAILED DESCRIPTION OF A PREFERRED EMBODIMENT

Figure 1:
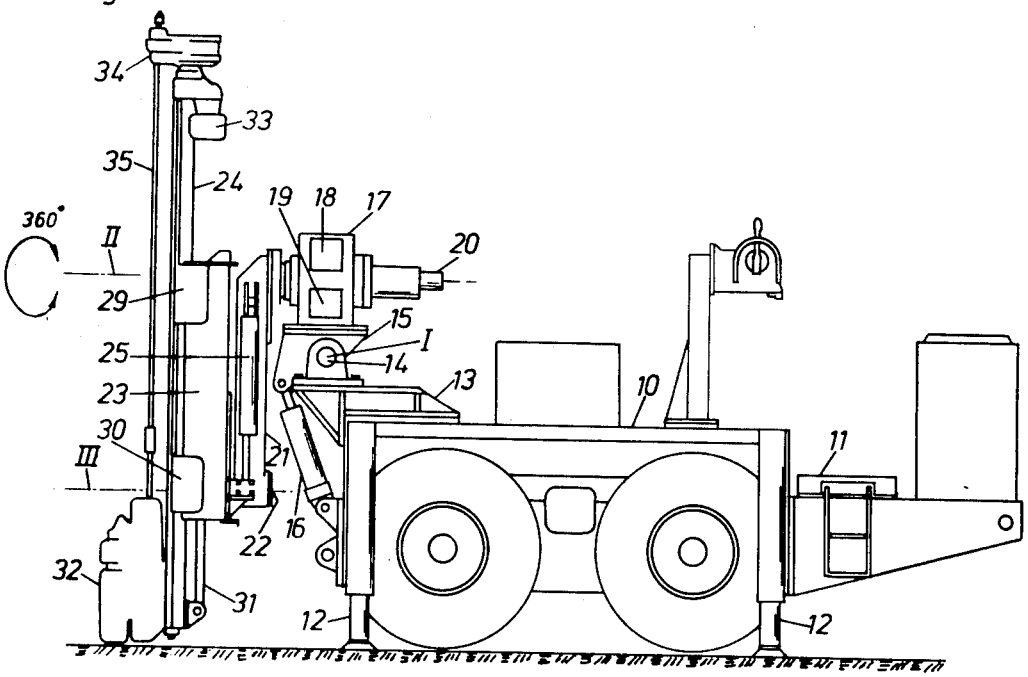
FIG. 1 is a side view of a ring drilling rig according to the invention.

The ring drilling rig shown on the drawings has a wheeled chassis 10 that is provided with four hydraulically extendible support legs 12 that are lowered to carry the chassis in a conventional way during drilling. The chassis carries an operator's platform 11 at one end thereof. The other end of the chassis has a bracket 13 that carries a support unit 15 through a horizontal transverse pivot 14. The support unit 15 is swingable about the axis I of the pivot 14 by means of a double-acting hydraulic jack 16 that is pivotably coupled between the chassis 11 and the support unit 15. A turning device 17 is part of the support unit 15. It is conventional and is not shown in detail. Turning device 17 comprises two horizontal hydraulic cylinders 18, 19 with internal pistons that are built together with racks (not illustrated). The racks mesh with a non-illustrated pinion that is affixed on a shaft 20, the axis of which has been denoted by II. An arm 21 is affixed to the end of the shaft 20, and it is perpendicular to the shaft 20. By means of the turning device 17, this arm can be swung 360° about the axis II. At the end position of a complete turn, the arm is horizontal. Unlimited rotatability about axis II is not necessary, but turnability over a complete turn is sufficient. A pivot 22, the axis of which has been denoted by III is mounted on the outer free end of the arm 21, and a holder 23 for a feed beam 24 is mounted on this pivot. By means of two hydraulic jacks 25, 26 that are pivotably mounted between brackets 27 on the holder 23 and brackets 28 on the arm 21, the feed beam holder 23 and thereby the feed beam 24 can be swung about the axis III of the pivot 22 about 45° or more in both directions from their position in parallel with the arm 21. The feed beam 24 is axially displaceable in guides 29, 30 on the holder by means of a hydraulic jack that is mounted in the holder 23 and has its piston rod 31 coupled to the feed beam 24. An impact rock drill 32 is displaceable along the feed beam 24 by means of a hydraulic feed motor 33 that rotates a conventional non-illustrated feed screw inside the feed beam 24. A centralizer 34 for the drill rod 35 is mounted on the front end of the feed beam. The axes II and III are parallel with each other and they are perpendicular to the axis I and to the longitudinal axis of the drill rod 35.

Figure 5:
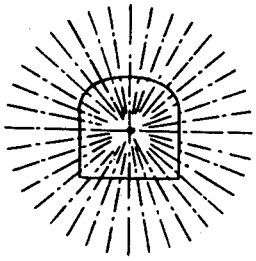
FIGS. 5–7 show various drilling patterns that can be drilled with the rig as it is shown in FIGS. 1 and 2.

In FIG. 5 there is shown a transverse section through a drift in the middle of an ore body. This drift is drilled in a complete ring-pattern. The length of the holes can for instance be about twenty meters. All adjustment between the holes is made by turning about the axis II. The feed beam 24 is maintained parallel with the arm 23 so that the axis of drilling, i.e. the axis of the drill rod 35, always intersects the axis II. The jack 31 is used to advance the feed beam 24 into close proximity to the rock before the drilling of a hole starts.

Figure 6:
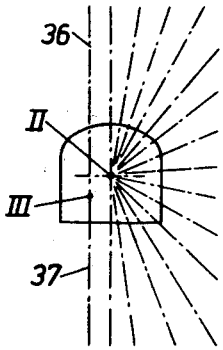

In FIG. 6 there is shown another drift that extends along the wall between the ore and the rock. Holes 36, 37 are drilled upwards and downwards respectively along the vertically dipping ore wall that extends through the drift. The ore is to the right of the holes 36, 37. The other holes are drilled in the same pattern as in FIG. 5. The holes 36, 37 can be drilled along the wall also when the wall is not vertical.

Figure 7:
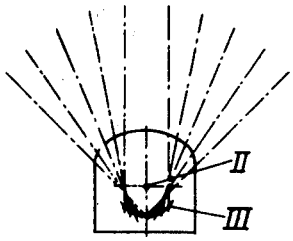

In FIG. 7 there is shown a fan drilling pattern. The feed beam 24 is all the time held at a constant angle to the right and to the left respectively relative to the arm 21 as can be understood from the figure. A fan as shown in FIG. 7 should advantageously be inclined. This is accomplished by tilting the axis II by means of jack 16. Also in ring drilling, it can be desirable to tilt axis II. The axis II can be tilted both forwards and backwards.

Figure 2:
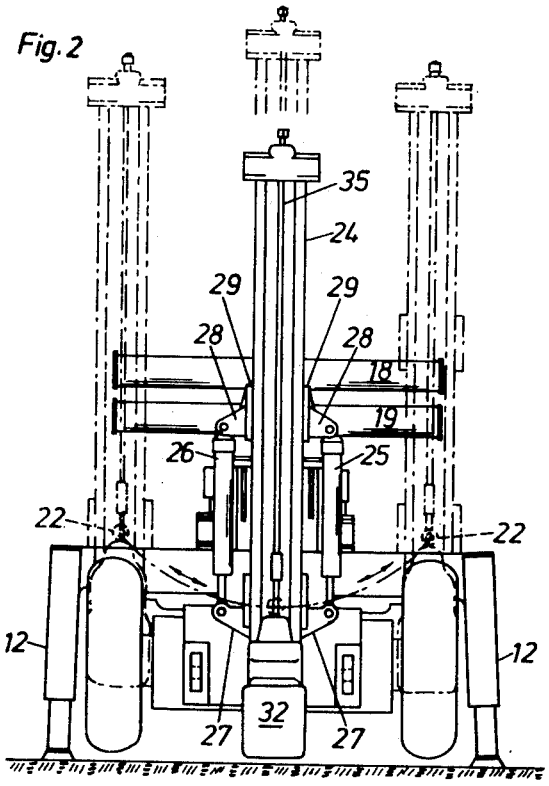
FIG. 2 is a front view of the drill shown in FIG. 1.
Figure 3:
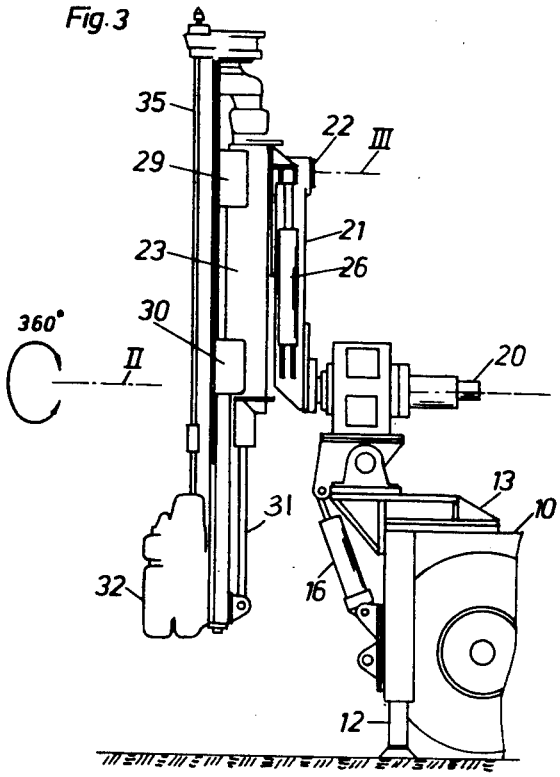
FIG. 3 is a side view of a part of the rig shown in FIGS. 1 and 2 but showing a feed beam for a rock drill mounted 180° turned relative to FIGS. 1–2.
Figure 4:
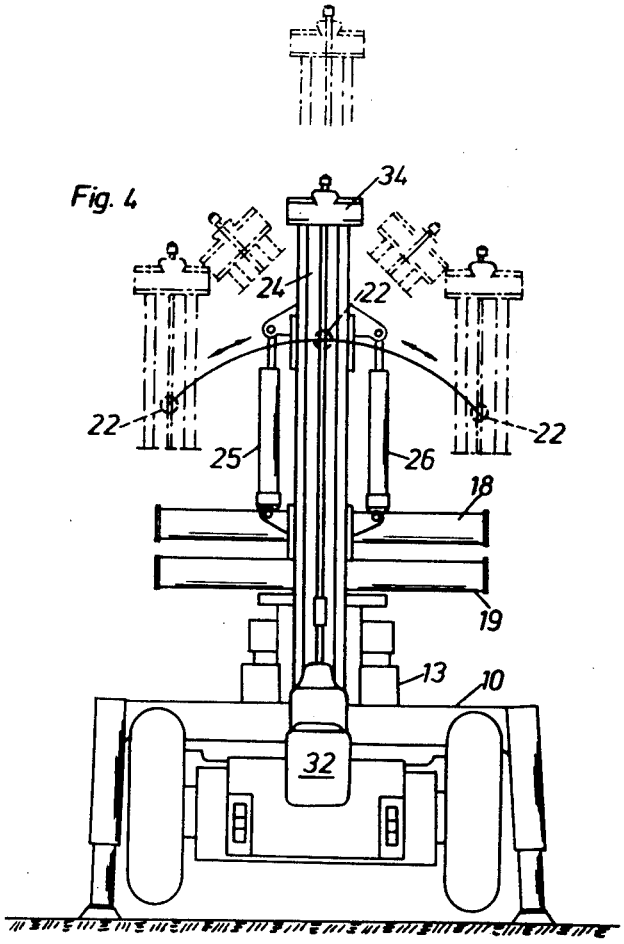
FIG. 4 is a front view of the rig mounted as shown in FIG. 3.

In FIGS. 3 and 4, the arm 21 carring the feed beam 24 and the feed beam extension jack 31 is turned 180° relative to FIGS. 1 and 2. In this alternative, the axis III is lowered when the arm 21 is swung from its middle position. Since the feed beam 24 is thus lowered as can be seen in FIG. 4 when displaced laterally, it follows the arc of the roof. This is advantageous when drilling in small drifts in which a relatively short feed beam 24 must be used since the length of the possible extension of the feed beam will also be shorter when a shorter feed beam is used. In FIG. 2 there is indicated by dotted lines that the feed beam raises when the arm 21 is swung from its middle position. This can be compensated for by extending the feed beam 24 by means of jack 31 as is also illustrated in the FIG. 2.

What we claim is:

1. A ring drilling rig comprising:

a chassis (10), a support (15) swingably mounted on the chassis (10) at one end thereof so as to be tiltable about a first horizontal axis (I) that is transverse to the chassis, power means (16) coupled to said support (15) to tilt said support (15) relative to said chassis (10), an arm (21) swingably mounted to said support (15) so as to be swingable about a second axis (II) that is perpendicular to said first axis (I), power means (17) coupled to said arm (21) to swing said arm (21) about said second axis (II) through an arc of 360°, said arm (21) being always transverse to said second axis (II), and a feed beam (24) swingably mounted on the distal end of said arm (21) and being transverse to said second axis (II), said feed beam (24) being swingable on said arm (21) about a third axis (III) parallel with said second axis (II), said third axis (III) being coupled to said support (15) via said second axis (II).

2. A ring drilling rig according to claim 1 further comprising a holder (23) carrying said feed beam (24), said feed beam (24) being axially displaceably mounted in said holder (23) and said holder (23) being swingable about said third axis (III).

3. A ring drilling rig according to claim 2 comprising a hydraulic jack (31) coupled between said feed beam (24) and said holder (23) to effect said axial displacement of said feed beam in said holder.

4. A ring drilling rig according to claim 3 wherein said feed beam (24) and said hydraulic jack (31) are mountable in said holder (23) axially facing in one direction and alternatively in the other direction.

5. A ring drilling rig according to claim 1 wherein said feed beam (24) is swingable on said arm (21) into a position in which the axis of drilling intersects said second axis (II).

6. A ring drilling rig according to claim 1 wherein said arm (21) is swingable through said arc of 360° from a position in which it is substantially horizontal.

7. A ring drilling rig according to claim 1 wherein said feed beam (24) is swingable solely in a plane perpendicular to said second axis (II).

8. A ring drilling rig according to claim 1 comprising a shaft (20) rotatably mounted to said support (15), the longitudinal axis of said shaft (20) being parallel to and defining said second axis (II), and wherein said arm (21) is affixed to said shaft (20) so as to be normal to said shaft (20).

9. A ring drilling rig according to claim 8 comprising a hydraulically actuated rack-and-pinion device coupled to said shaft (20) for rotating said shaft (20) relative to said support (15).

10. A ring drilling rig according to claim 8 wherein said arm (21) is swingable through said arc of 360° from a position in which it is substantially horizontal.

11. A ring drilling rig according to claim 2 wherein said feed beam (24) is swingable solely in a plane perpendicular to said second axis (II).

12. A ring drilling rig according to claim 2 wherein said holder (23) is swingable on said arm (21) into a position in which the axis of drilling intersects said second axis (II).

13. A ring drilling rig according to claim 2 wherein said arm (21) is swingable through said arc of 360° from a position in which it is substantially horizontal.

14. A ring drilling rig according to claim 1 wherein said arm (21) is directed from said support (15) in a direction opposite to the direction of drilling.

15. A ring drilling rig according to claim 2 wherein said arm (21) is swingable through said arc of 360° from a position in which it is substantially horizontal.

16. A ring drilling rig according to claim 1 wherein said second axis (II) is tiltable about said first horizontal axis (I) upon tilting of said support (15) about said first horizontal axis (I).

17. A ring drilling rig according to claim 1 wherein said arm (21) always extends perpendicular to said second axis (II).

* * * * *